US005343821A

United States Patent [19]

Tseng

[11] Patent Number: 5,343,821

[45] Date of Patent: Sep. 6, 1994

[54] SEWING MACHINE HAVING AN ACCESSORY BOX

[76] Inventor: Hsien-Chang Tseng, P.O. Box 63-151, Taichung, Taiwan

[21] Appl. No.: 69,822

[22] Filed: Jun. 1, 1993

[51] Int. Cl.[5] ..... D05B 73/00

[52] U.S. Cl. ..... 112/258; 312/334.27

[58] Field of Search ..... 112/258, 260, 217.1; 312/334.23, 334.27, 330.1, 21, 29

[56] References Cited

U.S. PATENT DOCUMENTS 3,673,972 7/1972 Grange ..... 112/258
3,781,075 12/1973 Fresard ..... 112/258
3,825,310 7/1974 Roemer ..... 312/334.27 X
4,220,103 9/1980 Kasahara et al. ..... 112/260

*Primary Examiner*—Peter Nerbun
*Attorney, Agent, or Firm*—Baxley, Charles E.

[57] ABSTRACT

A sewing machine includes a pair of rods slidably disposed in the base, the rods are parallel with each other, an accessory box having two or more protrusions extended downward for fixing to the rods such that the accessory box moves in concert with the rods, the accessory box is movable inward and outward of the base in order for accommodating accessories of the sewing machine.

2 Claims, 3 Drawing Sheets

SEWING MACHINE HAVING AN ACCESSORY BOX

BACKGROUND OF THE INVENTION (a) Field of the Invention

The present invention relates to a sewing machine, and more particularly to a sewing machine having an accessory box.

(b) Description of the Prior Art

Typical portable sewing machines comprising a housing for accommodating the parts of the sewing machine, the parts occupy the whole space of the housing such that no room or no space is available in the housing and such that no accessory boxes can be provided in the sewing machine, the accessories of the sewing machine, such as scissors, rolls, buttons, etc. can thus not be easily carried with the sewing machine. This is inconvenient.

The present invention has arisen to mitigate and/or obviate the afore-described disadvantages of the conventional sewing machines.

SUMMARY OF THE INVENTION

The primary objective of the present invention is to provide a sewing machine having an accessory box for accommodating the accessories of the sewing machine.

In accordance with one aspect of the present invention, there is provided a sewing machine comprising a base, a pair of rods slidably disposed in the base, an accessory box including at least two protrusions extended downward therefrom and fixed to the rods respectively such that the accessory box moves in concert with the rods, whereby, the accessory box is movable inward and outward of the base.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
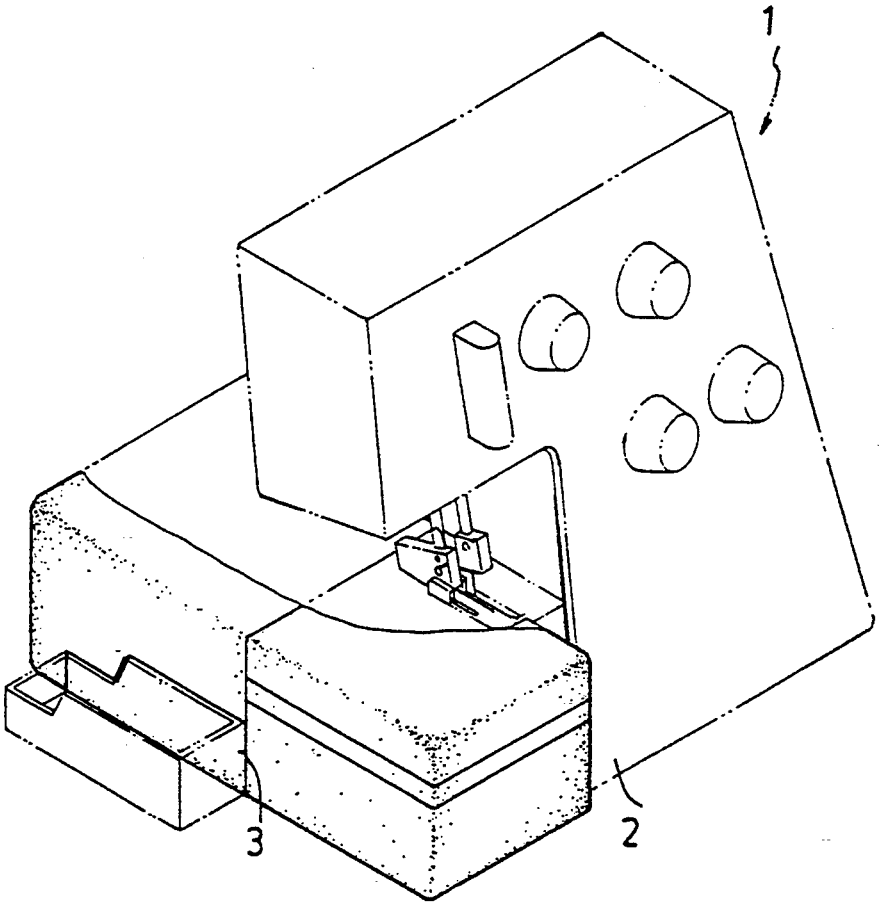
FIG. 1 is a perspective view of a sewing machine in accordance with the present invention, in which part of the sewing machine is shown in dotted lines.

Referring to the drawings and initially to FIG. 1, a sewing machine in accordance with the present invention comprises generally a body 1 having a base 2 formed in the bottom portion, and an accessory box 3 provided in the base 2 and engageable in the base 2 for accommodating the accessories of the sewing machine.

Figure 2:
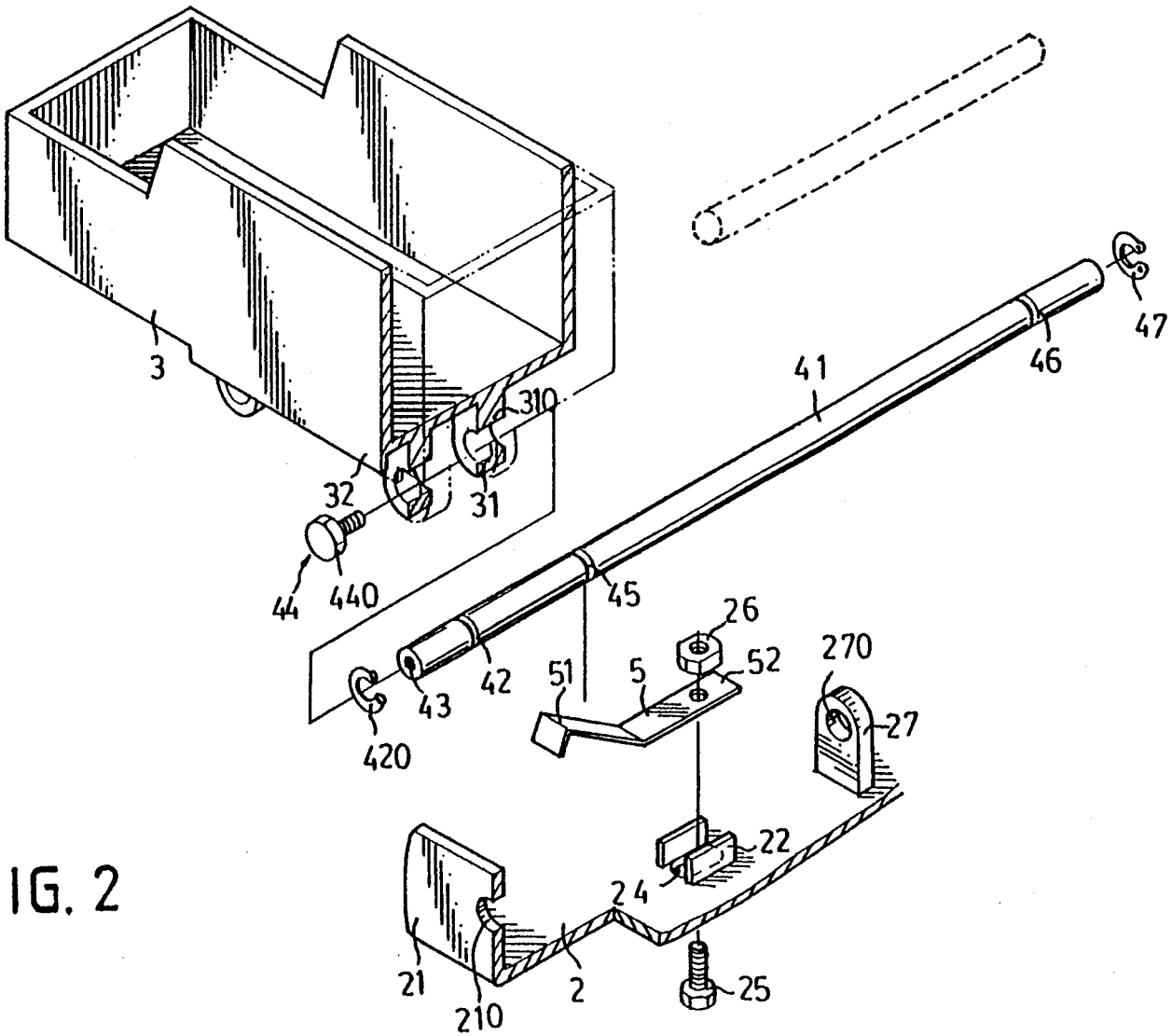
FIG. 2 is an exploded view of the accessory box of the sewing machine.
Figure 3:
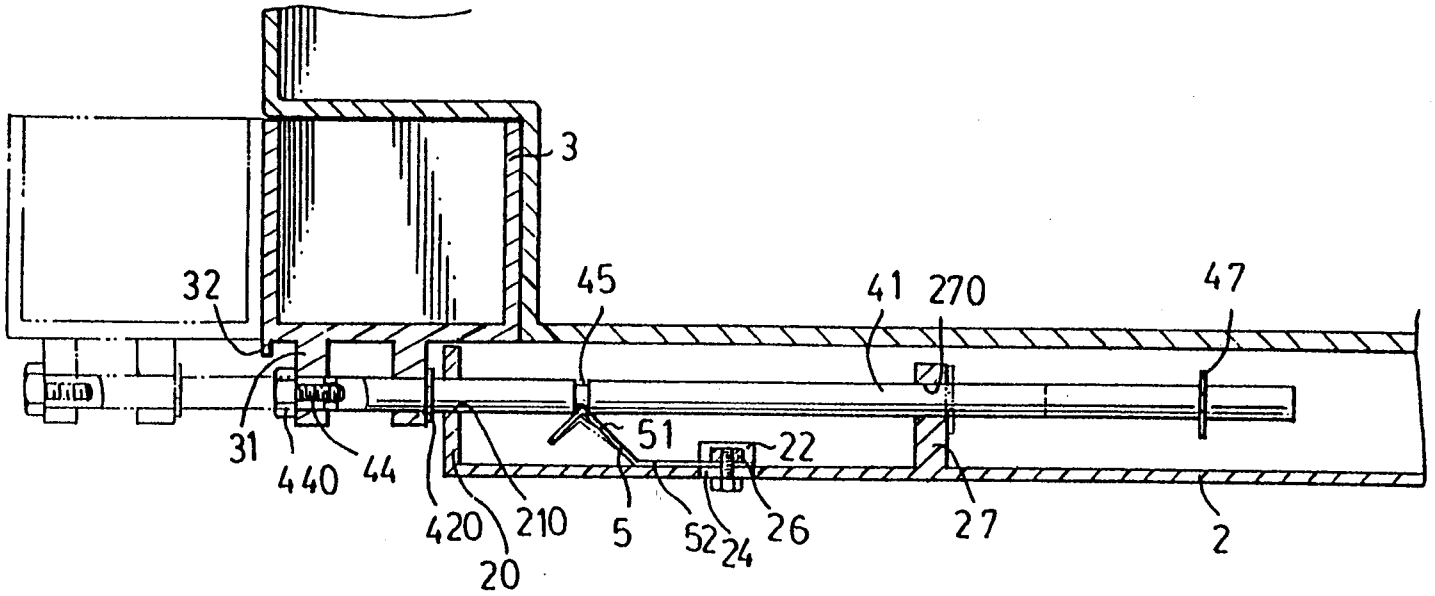
FIG. 3 is a cross sectional view of the accessory box of the sewing machine.

Referring next to FIGS. 2 and 3, the base 2 of the sewing machine comprises a panel 21 and a lug 27 extended upward from the bottom thereof, a hole 210 and an aperture 270 formed in the panel 21 and the lug 27 respectively, a pair of walls 22 extended upward from the bottom of the base 2 and located between the panel 21 and the lug 27, an opening 24 formed between the walls 22, a spring 5 having a bent portion 51 formed in one end thereof and having the other end portion 52 engaged between the walls 22 and fixed to the base 2 by a bolt 25 and a nut 26, a rod 41 slidably engaged in the hole 210 of the panel 21 and in the aperture 270 of the lug 27, a clamping ring 47 engaged in the annular groove 46 which is formed in the rear end of the rod 41 so as to limit the forward or outward movement of the rod 41, an annular groove 45 formed in the middle portion of the rod 41 for engaging with the bent portion 51 of the spring 5, another clamping ring 420 engaged in the annular groove 42 which is formed in the front end portion of the rod 41, and a screw hole 43 formed in the front end of the rod 41 for engaging with the bolts 44 each having a head 440 formed thereon. Similarly, another rod (as shown in dotted lines in FIG. 2) is slidably supported in the base and is parallel to the rod 41.

The accessory box 3 includes two pairs of protrusions 31 extended downward therefrom, an orifice 310 is formed in each of the protrusions 31 for engaging with the rods 41, the protrusions 31 are engaged with the clamping rings 420 and the bolts 44 such that the accessory box 3 is fixed to the rods 41 and move in concert with the rods 41 , whereby, the accessory box 3 can be pulled outward of the base 2 of the sewing machine and can be pushed inwards of the base 2 by the sliding movement of the rods 41 . It is preferable that a rib 32 is extended downward from the front portion of the accessory box 3 for facilitating the pulling of the box 3.

As best shown in FIG. 3, the annular groove 45 is arranged to be engaged with the bent portion 51 of the spring 5 when the rods 41 are moved inwards of the base 2 and when the accessory box 3 is received in the base 2 of the sewing machine.

Accordingly, the sewing machine in accordance with the present invention includes an accessory box provided therein for accommodating accessories of the sewing machine.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sewing machine comprising a body including a base formed in a bottom portion thereof, a pair of rods slidably disposed in said base, a box including at least two protrusions extended downward therefrom and fixed to said rods respectively such that said box moves in concert with said rods, at least one of said rods including an annular groove formed therein, a spring including a first end disposed on said base and including a second end having a bent portion formed thereon for engaging with said annular groove of said rod so as to retain said rod in place.

2. A sewing machine according to claim 1, wherein said box includes two pairs of protrusions extended downward therefrom for engaging with said rods respectively, a clamping ring is fixed to each of said rods, each clamping ring being engaged with a respective protrusion, and a bolt fixed to each of said rods, each bolt being engaged with a respective protrusion, said protrusions are engaged between said clamping rings and said bolts so as to fix said box to said rods.

* * * * *